US009955535B2

(12) United States Patent
Edwards et al.

(10) Patent No.: US 9,955,535 B2
(45) Date of Patent: Apr. 24, 2018

(54) MEAL KIT AND COOKING TRAY

(71) Applicant: Kraft Foods Group Brands LLC, Northfield, IL (US)

(72) Inventors: Jay Edwards, Madison, WI (US); Neil Darin, Grayslake, IL (US)

(73) Assignee: Kraft Foods Group Brands LLC, Chicago, IL (US)

( * ) Notice: Subject to any disclaimer, the term of this patent is extended or adjusted under 35 U.S.C. 154(b) by 435 days.

(21) Appl. No.: 13/929,050

(22) Filed: Jun. 27, 2013

(65) Prior Publication Data

US 2013/0284726 A1 Oct. 31, 2013

Related U.S. Application Data

(62) Division of application No. 13/046,119, filed on Mar. 11, 2011, now Pat. No. 8,492,688, which is a division
(Continued)

(51) Int. Cl.
*H05B 6/80* (2006.01)
*H05B 6/64* (2006.01)
(Continued)

(52) U.S. Cl.
CPC ..... *H05B 6/6494* (2013.01); *B65D 5/5002* (2013.01); *B65D 81/3453* (2013.01); *B65D 2231/005* (2013.01); *B65D 2581/3425* (2013.01); *B65D 2581/3428* (2013.01); *B65D 2581/3498* (2013.01)

(58) Field of Classification Search
CPC ..... B65D 5/5002; B65D 81/3453; B65D 2231/005; B65D 2581/3428; B65D 2581/3498; B65D 2581/3425; H05B 6/6494
USPC ..... 219/725, 728–730, 734, 756, 759; 426/107, 109, 234, 241, 243, 120; 99/DIG. 14; 220/16, 23.4, 23.83, 23.86,
(Continued)

(56) References Cited

U.S. PATENT DOCUMENTS 386,599 A 7/1888 Neville
1,292,476 A 1/1919 Kavanagh
(Continued)

FOREIGN PATENT DOCUMENTS

EP 0 429 488 B1 9/1994
JP 08324537 A 12/1996
(Continued)

OTHER PUBLICATIONS

AIPN Translation online of JP2005-053511A, Tray, Jun. 5, 2015.*

*Primary Examiner* — Quang Van
(74) *Attorney, Agent, or Firm* — Fitch, Even, Tabin & Flannery LLP

(57) ABSTRACT

A meal kit for microwave cooking of a multi-component food product is provided that includes at least two sealed packages of ingredients for the multi-component food product. One of the sealed packages of ingredients contains a liquid component of the multi-component food product. The meal kit also includes a cooking tray formed of a microwave-safe material having a bottom wall with an upstanding sidewall extending around the periphery thereof to define an interior of the cooking tray. Outer packaging is provided to contain the sealed packages of ingredients and the cooking tray.

2 Claims, 10 Drawing Sheets

Related U.S. Application Data of application No. 11/302,599, filed on Dec. 14, 2005, now Pat. No. 7,939,786.

(51) Int. Cl.

| | |
|---|---|
| ***B65D 1/40*** | (2006.01) |
| ***B65D 1/34*** | (2006.01) |
| ***B65D 5/50*** | (2006.01) |
| ***B65D 81/34*** | (2006.01) |

(58) Field of Classification Search

USPC ..... 220/23.87, 359.2, 359.4, 270; 428/35.7, 428/35.4, 34.3, 34.7, 213

See application file for complete search history.

(56) References Cited

U.S. PATENT DOCUMENTS

| | | | | | |
|---|---|---|---|---|---|
| 3,184,319 | A | | 5/1965 | Fritsche | |
| 3,339,725 | A | | 9/1967 | Hamilton | |
| 3,425,340 | A | | 2/1969 | Price | |
| 3,958,035 | A | | 5/1976 | Stearns | |
| 4,065,583 | A | | 12/1977 | Ahlgren | |
| 4,176,593 | A | | 12/1979 | Terzian | |
| 4,184,421 | A | | 1/1980 | Ahlgren | |
| 4,320,699 | A | | 3/1982 | Binks | |
| 4,523,675 | A | * | 6/1985 | Schroter | 206/764 |
| 4,555,605 | A | | 11/1985 | Brown et al. | |
| 4,612,431 | A | | 9/1986 | Brown et al. | |
| 4,966,296 | A | | 10/1990 | Farrell | |
| 5,115,524 | A | * | 5/1992 | Antosko | 5/99.1 |
| 5,140,119 | A | | 8/1992 | Brown et al. | |
| D339,501 | S | | 9/1993 | Haynes | |
| 5,270,502 | A | | 12/1993 | Brown et al. | |
| 5,352,465 | A | | 10/1994 | Gondek et al. | |
| 5,353,943 | A | | 10/1994 | Hayward | |
| 5,407,751 | A | | 4/1995 | Genske et al. | |
| 5,416,305 | A | | 5/1995 | Tambellini | |
| 5,445,840 | A | | 8/1995 | Wadell | |
| 5,565,228 | A | * | 10/1996 | Gics | 426/107 |
| 5,660,300 | A | | 8/1997 | Demetrio | |
| 5,782,374 | A | | 7/1998 | Walker | |
| 5,935,480 | A | | 8/1999 | Takeoka et al. | |
| 6,048,558 | A | | 4/2000 | Feldmeier et al. | |
| 6,065,394 | A | * | 5/2000 | Gelderman | 99/449 |
| 6,137,099 | A | | 10/2000 | Hamblin | |
| 6,298,992 | B1 | | 10/2001 | Tsao | |
| 6,307,193 | B1 | | 10/2001 | Toole | |
| 6,413,599 | B1 | | 7/2002 | Petricca et al. | |
| 6,490,796 | B1 | | 12/2002 | Armienta | |
| 6,680,092 | B1 | | 1/2004 | Levy | |
| 6,696,677 | B2 | | 2/2004 | Kennedy | |
| 6,717,121 | B2 | * | 4/2004 | Zeng et al. | 219/730 |
| 6,829,984 | B1 | | 12/2004 | Leibowitz | |
| 2004/0020915 | A1 | * | 2/2004 | Shei | 219/385 |
| 2004/0023000 | A1 | | 2/2004 | Young et al. | |
| 2005/0281919 | A1 | | 12/2005 | Ueno et al. | |

FOREIGN PATENT DOCUMENTS

| | | | |
|---|---|---|---|
| JP | 2005053511 | A | 3/2005 |
| WO | 96/15958 | A1 | 5/1996 |
| WO | 2004/013015 | A1 | 2/2004 |

* cited by examiner

MEAL KIT AND COOKING TRAY

CROSS-REFERENCE TO RELATED APPLICATION

This application is a divisional of prior application No. 13/046,119 filed Mar. 11, 2011, which is a divisional of prior application No. 11/302,599, filed Dec. 14, 2005, now issued as Pat. No. 7,939,786, which are hereby incorporated herein by reference in their entirety.

FIELD

This disclosure generally relates to a meal kit having a cooking tray, and in particular relates to a meal kit and a cooking tray for microwave cooking of a food product in the cooking tray.

BACKGROUND

Pre-made and pre-packaged food dishes food dishes which require a minimum amount of consumer preparation and are quick to prepare are common items on grocery store shelves and in refrigerator or freezer cases. Generally, such pre-made and pre-packaged food dishes are provided in a combined heating and serving vessel. Typically, such food dishes will be eaten as packaged or after a brief heating period, often by microwave heating. The food dish typically contains multiple ingredients, such as various combinations of vegetables, cheese, rice and pasta, that are premixed together. Such a pre-made and pre-packaged food dish does not require much more activity on the part of a consumer to heat than removing any external wrapper, placing the vessel containing the food dish in a microwave oven, and beginning the microwave cooking cycle. Although convenient, such pre-made and pre-packaged food dishes are often not customizable. That is, the food dish is essentially already prepared, only requiring heating and perhaps stirring. Thus, a consumer does not have the opportunity to selectively use the ingredients, such as by omitting a non-preferred ingredient.

SUMMARY

A meal kit for microwave cooking of a multi-component food product is disclosed. The meal kit includes at least a first and a second sealed package. Each of the sealed packages contains an ingredient of the multi-component food product. At least one of the packages contains a volume of a liquid component of the multi-component food product and at least one of the sealed packages contains a volume of a solid component of the multi-component food product. The meal kit also includes a cooking tray formed from a microwave safe material. The cooking tray has a bottom wall with an upstanding side wall extending around the periphery thereof to define an interior of the cooking tray. The interior of the cooking tray is larger than the combined volume of the liquid and solid components of the multi-component food product in order to permit the liquid and solid components of the multi-component food product to be contained in the interior of the cooking tray. The sealed packages and the cooking tray are contained by outer packaging.

The cooking tray may have a radially extending rim extending around a periphery of the upstanding side wall and on edge thereof that is opposite the bottom wall. The rim may include a pair of tabs on opposing sides thereof that project radially outward. The cooking tray may be substantially circular in shape; however, other shapes, such as rectangular or ovular, may also be utilized.

A removable liner film may be attached to the entirety of the bottom wall at least substantially all of the upstanding side wall on an interior side of the cooking tray. The removable film may also be attached to one of the tabs. The tab having the removable liner attached thereto may be separable from the remainder of the cooking tray, such as along a line of weakness therebetween. This will permit the removable tab to be separated along the line of weakness from the remainder of the cooking tray in order to provide a convenient grasping point for the removable film. The removable film can be at least partially lifted from the cooking tray, such as by using the removable tab, in order to fold, flip or remove the food product. The attachment between the removable film and the one of the tabs that is removable may be greater in strength than the attachment between the removable film and the remainder of the cooking tray.

The cooking tray may have one or more fold lines extending across the bottom wall to facilitate folding of the cooking tray and any food product disposed thereon. An aperture may be formed in the sidewall adjacent each end of the fold line to further facilitate folding of the cooking tray and any food product disposed thereon. It is preferable that the cooking tray not have an opening in the interior adjacent the food product so that the liquid component of the food product will not leak.

The outer packaging may have a slot through which one of the tabs of the cooking tray can project in order to generally secure the cooking tray relative to the outer packaging. In one aspect, the outer packaging may have a pair of slots, each positioned to receive one of the tabs of the cooking tray such that the tabs project through the slots in order to generally secure the cooking tray relative to the outer packaging. A pair of meal kits may be provided, and may be arranged such that their tabs are aligned and the aligned tabs project through a slot in the outer packaging.

The outer packaging may comprise a front panel, a back panel, and a pair of side panels. Each of the side panels may be connected to opposing side edges of the front and back panels to form a sleeve having an open bottom and an open top. A slot may be formed in one of the side panels for receiving a tab of the cooking tray in order to generally secure the cooking tray relative to the outer packaging. In one aspect, each of the front and back panels may be generally rectangular. Each of the pair of side panels may include two panels connected via a fold that is positioned outward relative to the side edges of the front and back panels. The slot may span the fold on one or both of the pair of side panels. In another aspect, the back panel may be generally rectangular and the front panel may have a rectangular portion substantially the same size as the back panel and upwardly extending semi-circular portion. The cooking tray may project upward through the top opening and have a portion generally aligned with a semi-circular portion of the front panel.

According to another aspect, the outer packaging may comprise a generally rectangular box. One of the sealed packages may comprise a rigid cup having a projecting rim. The rectangular box may have at least one slot through which the rim of the rigid cup can project in order to generally secure the rigid cup relative to the rectangular box. A slot may also be provided in a panel of the carton through which one of the tabs of the cooking tray can project in order to generally secure the cooking tray relative to the box.

DETAILED DESCRIPTION OF THE DRAWINGS

Figure 1:
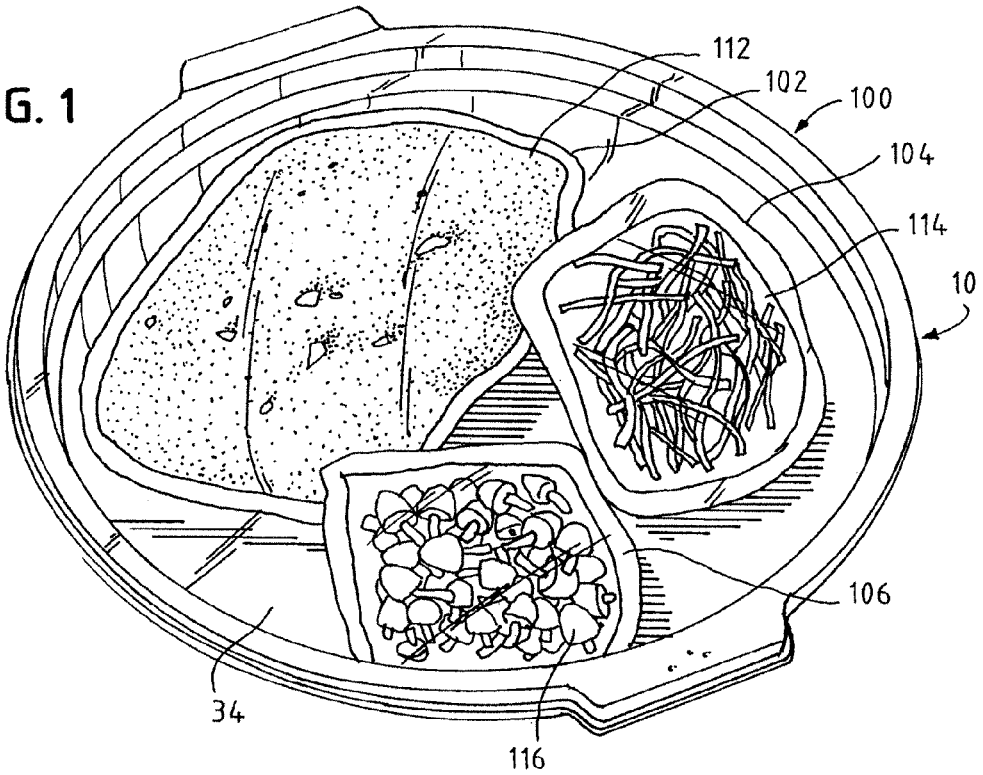
FIG. 1 is a perspective view of a first embodiment of a cooking tray containing a plurality of individually wrapped meal kit ingredients.
Figure 2:
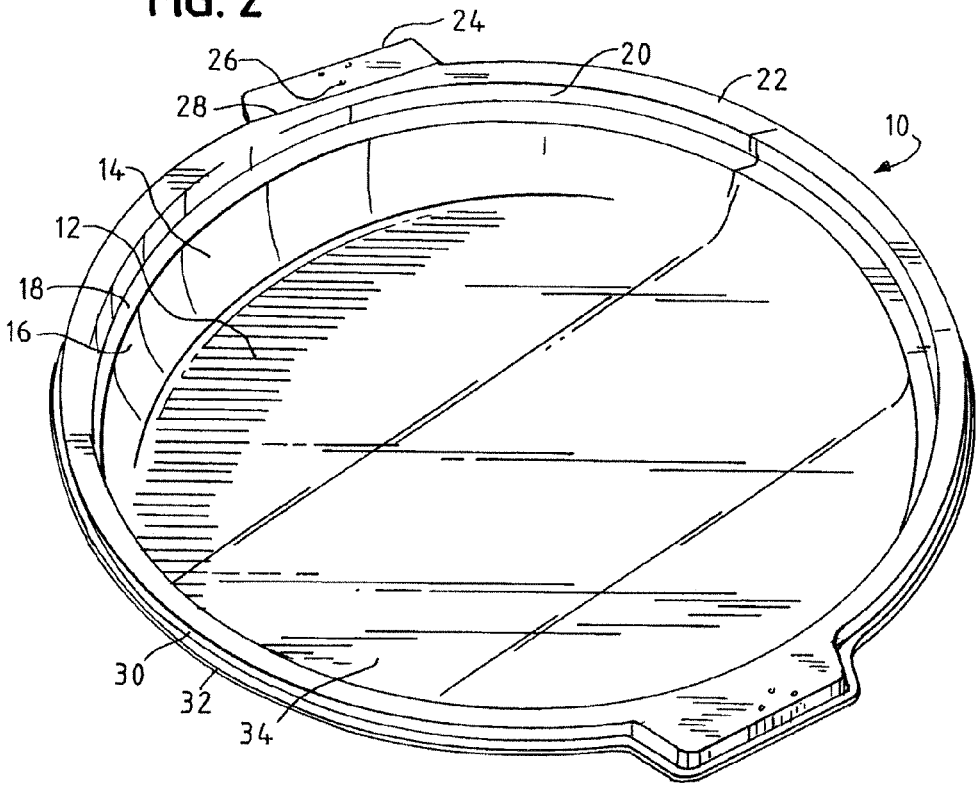
FIG. 2 is a perspective view of the cooking tray of FIG. 1 without the meal kit ingredients.
Figure 3:
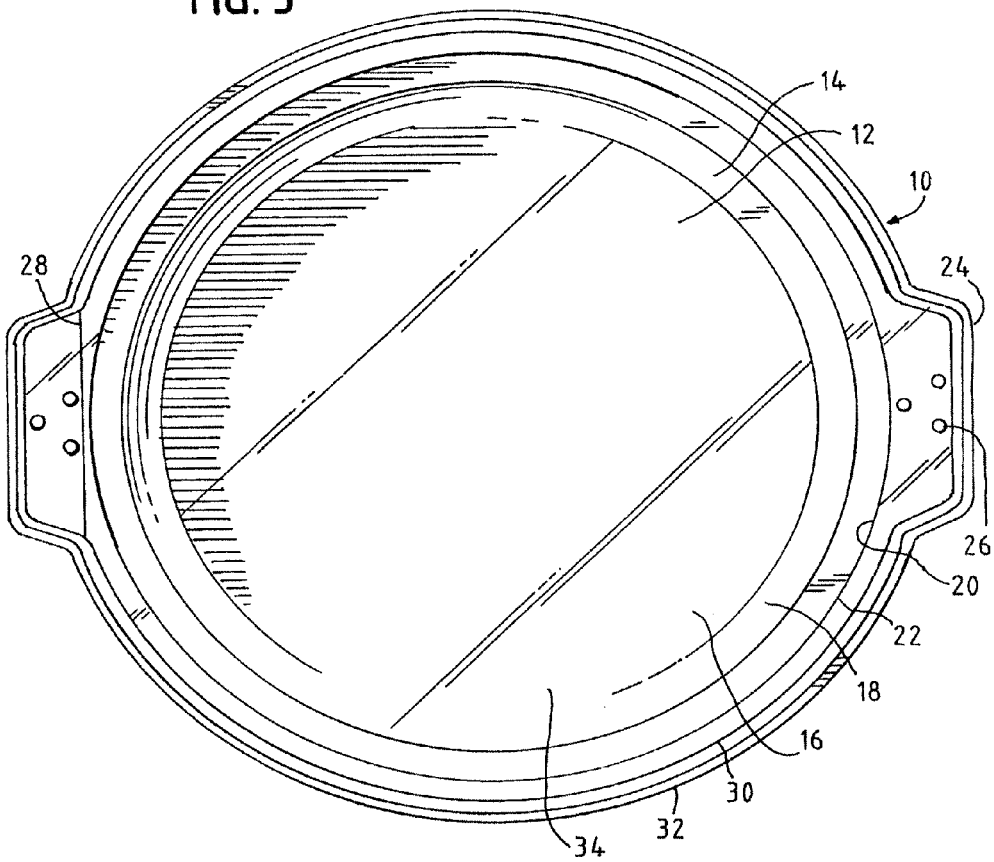
FIG. 3 is a top plan view of the cooking tray of FIG. 1 without the meal kit ingredients.
Figure 4:
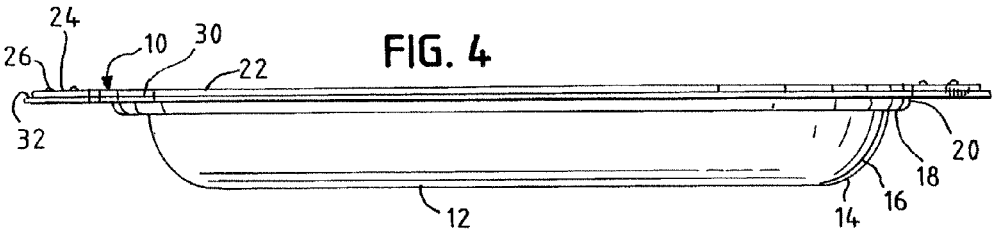
FIG. 4 is a side elevation view of the cooking tray of FIG. 1.

A meal kit 100 for microwave cooking of a multi-component food product 36, and components thereof, are disclosed and illustrated in FIGS. 1-16. The meal kit 100 includes at least two sealed packages 102, 104 and 106 of ingredients 112, 114 and 116 for the multi-component food product 36, one of which 102 contains a liquid component 112 of the multi-component food product 36. The meal kit 100 also includes a cooking tray 10 or 510 formed of a microwave-safe material having a bottom wall 12 or 512 with an upstanding sidewall 14 or 514 extending around the periphery thereof to define an interior of the cooking tray 10 or 510. Outer packaging 200, 300 or 400 is provided to contain the sealed packages 102, 104 and 106 of ingredients 112, 114 and 116 and the cooking tray 10 or 510.

In a first embodiment, the cooking tray 10 of the meal kit 100 has a circular bottom wall 12 with an upstanding sidewall 14 about the periphery thereof. The circular bottom wall 12 is generally planar. The sidewall 14 includes multiple segments, beginning with a curved segment 16 attached at its lower end to the bottom wall 12. Attached at an upper end of the curved segment 16 is a radially extending shelf 18 that is orientated generally parallel to the bottom wall 12. At an opposite end of the shelf 18 from the curved segment 16 is an upstanding wall 20 orientated generally perpendicular to the shelf 18. At the upper end of the upstanding wall 20, opposite the lower end attached to the shelf 18, is a radially extending rim 22 that is orientated generally parallel to the bottom wall 12. An edge of the rim 22 opposite the upstanding wall 20 is a depending rim wall 30 that is generally parallel to the upstanding wall 20. A radially extending shelf 32 is attached to the lower end of the depending rim wall 30 and is orientated generally parallel to the bottom wall 12 of the cooking tray 10. The multiple segments and walls 16, 18, 20, 22, 30 and 32 forming the sidewall 14 combine to provide for containment of a food product within an interior of the cooking tray 10 and to provide rigidity to the cooking tray 10.

Although the majority of the multiple segments and walls 16, 18, 20, 22, 30 and 32 forming the sidewall 14 are generally circular, the rim 22, depending rim wall 30 and shelf 32 deviate at two locations on the cooking tray 10 to form a pair of tabs 24. The tabs 24 project outwardly from opposing sides of the cooking tray 10 in order to provide locations for gripping the tray 10 spaced from the interior of the tray 10. During microwave cooking of a food product in the cooking tray 10, moisture from the food product may condense on the gripping tabs. To reduce the risk of such moisture from causing the tabs 24 to be slippery, a plurality of raised bumps 26 project upwardly from an upper surface of each of tabs to enhance the gripping of the tabs 24 after microwave cooking. The tabs 24 are also spaced from the interior of the cooking tray 10 a distance sufficient to allow the tabs 24 to be gripped without heat from a cooked food product causing discomfort.

Overlying at least the curved segment 16 of the upstanding sidewall 14, the bottom wall 12, and one of the tabs 24 of the cooking tray 10 is a flexible, removable film liner 34. The film liner 34 preferably, though not necessarily, overlies the entirety of the upstanding sidewall 14, including the multiple segments and walls 16, 18, 20, 22, 30 and 32 forming the sidewall 14, and both tabs 24. A variety of bond strengths can be used to secure the film liner 34 to the cooking tray 10. However, the bond strength is preferably selected to prevent inadvertent separation of the film liner 34 from the cooking tray 10, while permitting a user to readily peel the film liner 34 from the cooking tray 10.

Figure 5:
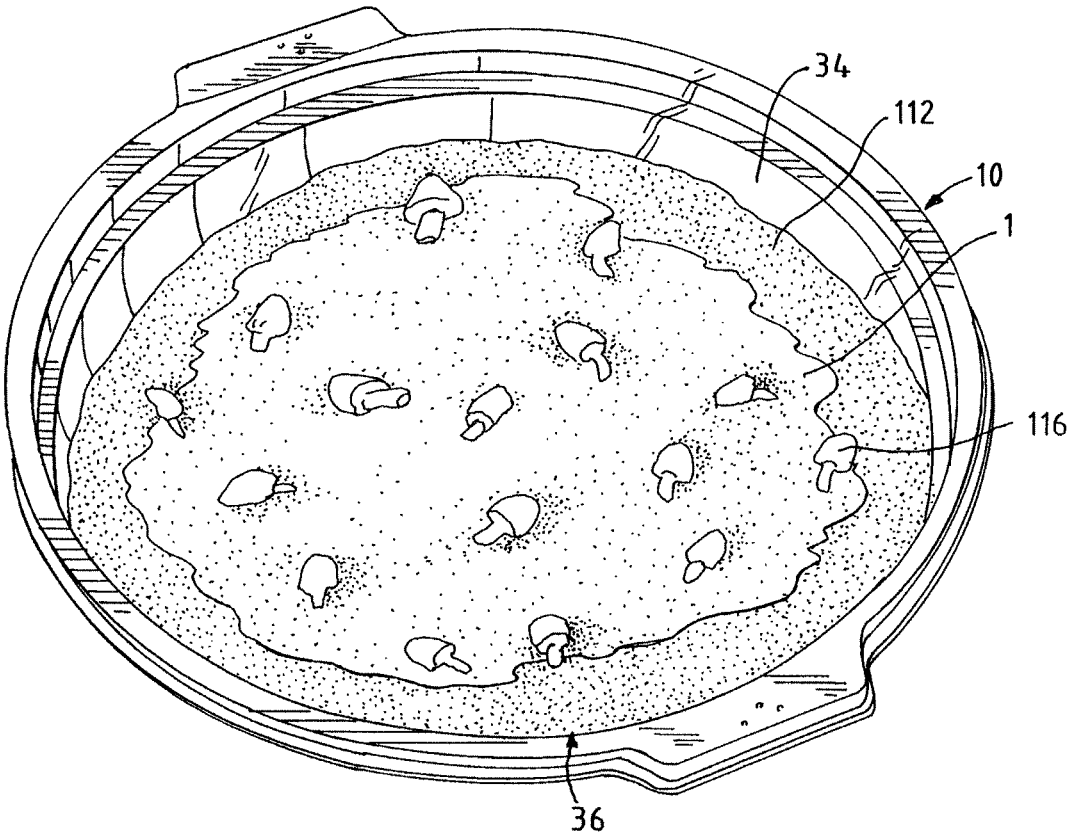
FIG. 5 is a perspective view of the cooking tray of FIG. 1 with the plurality of meal kit ingredients formed into an omelet therein.
Figure 5A:
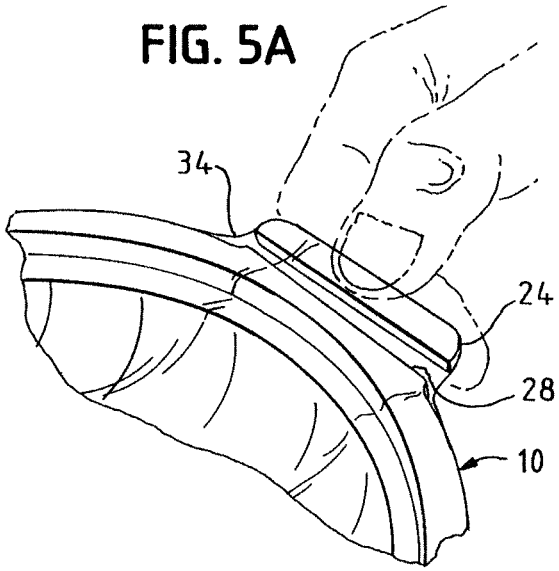
FIG. 5*a* is a detail view of an opening tab of the cooking tray of FIG. 5 being separated from the cooking tray.

For purposes that will be describe in greater detail herein, the film liner 34 is attached to one of the tabs 24 is a greater strength than that between the remainder of the film liner 34 and the cooking tray 10. The tab 24 having the film liner 34 attached thereto is separable from the remainder of the cooking tray 10 at a line of weakness 28 between the tab 24 and the adjacent portion of the rim 22. For example, the tab 24 can be separated from the remainder of the cooking tray 10 by bending the tab 24 either upward or downward about the line of weakness 28, as illustrated in FIG. 5*a*. Once the tab 24 is separated from the remainder of the cooking tray 10, the film liner 34, which is attached to both the separated tab 34 and the cooking tray 10, can be peeled from the remainder of the cooking tray 10 using the separated tab 24 as a gripping element to facilitate the peeling and provide a convenient location to grip the film.

Depending upon the type and/or size of the food product to be cooked in the cooking tray 10 using a microwave oven, one or more features may be provided to assist in improving the cooking of the food product. For example, the center of the food product may not heat at the same rate as the periphery of the food product. A feature than can be incorporated into the cooking tray 10 to improve cooking of the food product is a domed or otherwise raised portion of the cooking tray 10. By raising a portion of the cooking tray 10, such as the center, above the bottom of a microwave oven, microwave energy can reflect off of the bottom of the microwave oven and be redirected to the portion of the food product adjacent the raised portion of the cooking tray 10. In addition, heat may be trapped beneath the raised portion of the cooking tray 10 to assist in further heating of the food product during microwave cooking.

The film liner 34 may comprise a single layer or a multi-layer polyurethane material having a side facing the cooking tray 10 with a layer susceptible to bonding to the cooking tray 10 upon heating and, on an opposite side, a layer with non-stick properties selected to achieve sufficient release of a food product resting thereon after microwave cooking of the food product. The bonding or attachment between the cooking tray 10 and the film liner 34 may be through the use of heating the film liner 34 and/or the cooking tray 10 or the materials therefore. However, other ways of attaching the film liner 34 relative to the cooking tray 10 can also be used, such as merely forming the cooking tray 10 while the film liner material 34 is adjacent thereto without physically attaching them, such as would be the case with an adhesive. The film liner 34 is preferably, though not necessarily, tightly conformed to at least the bottom wall 12 and a portion of the upstanding sidewall 14 of the cooking tray 10. The cooking tray 10 may be formed from a sheet of plastic material having a thickness of about 0.018 inches.

The cooking tray 10 and the film liner 34 may be formed simultaneously using a thermal, vacuum forming process where the sheet of material for the cooking tray 10 and a sheet of material for the film liner 34 are overlayed, heated, and then drawn into a mold cavity to conform the materials into the shape of the cooking tray 10. Once the sheets, having the shape of the cooking tray 10 formed therein, are removed from the mold cavity, a cutting tool can be used to separate the cooking tray 10 and adjacent film liner 34 from the remainder of the sheets. During this step, the cutting tool may also be used to form the line of weakness 28 between the removable tab 24 and the remainder of the cooking tray 10. Using such a process is one method of attaching the liner film 34 to the cooking tray 10 in a tightly conforming arrangement.

In one example, the cooking tray 10 has an outer diameter of between about 7 and 10 inches, and preferably of about 8.5 inches, an inner diameter measured at the top edge of the curved segment 16 of between about 6 and 9 inches, and preferably about 7 inches, a total depth of between about 0.5 and 2 inches, and preferably about 1 inch, and an interior depth, measured from the top edge of the curved segment 16 of between about 0.3 and 1.8, and preferably about 0.8 inches. The gripping tabs 24 may each have a length, extending tangent to the rim 22, of between about 1 and 3 inches, and preferably about 2 inches and a radial extent of between about 0.2 and 1 inch, and preferably about 0.3 inches.

In a second embodiment, illustrated in FIGS. 12-16, the cooking tray 510 of the meal kit 100 has a circular bottom wall 512 with an upstanding sidewall 514 about the periphery thereof. The circular bottom wall 512 is generally planar. The sidewall 514 includes multiple segments, beginning with a curved segment 516 attached at its lower end to the bottom wail 512. Attached at an upper end of the sidewall 514 is a radially extending rim 518 that is orientated generally parallel to the bottom wall 12. The curved segment 516 of the bottom wall 512 can assist in removal of a food product from the cooking tray 510, such as with a spoon or other utensil, as compared to if the sidewall 514 and bottom wall 512 met at a sharp angle. In addition, the curved segment 516 and the rim 518 of the sidewall 514 can assist in providing rigidity to the cooking tray 10.

The bottom wall 512 of the cooking tray 510 has a fold line 522 extending substantially thereacross. The fold line 522 is a weakening or crease formed In the bottom wall 512. Positioned on the sidewall 514 are a pair of apertures 520. Each of the apertures 520 is preferably, though not necessarily, aligned with the fold line 522. One of the apertures 520 may be aligned with one end of the fold line 522, and the other of the apertures 520 may be aligned with another end of the fold line 522. The apertures 520 function to reduce the hoop strength of the sidewall 514 in preselected locations. The apertures 520 and the fold line 522 combine to define a preselected region where the cooking tray 510 is more susceptible to folding. Thus, the cooking tray 510 can be folded along the fold line 522 in order to fold a food product disposed thereon.

Figure 13:
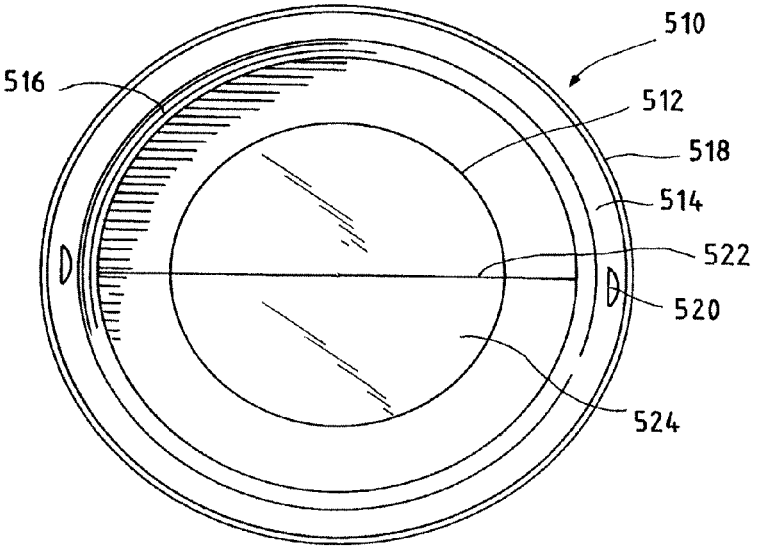
FIG. 13 is a top plan view of the cooking tray of FIG. 12.
Figure 15:
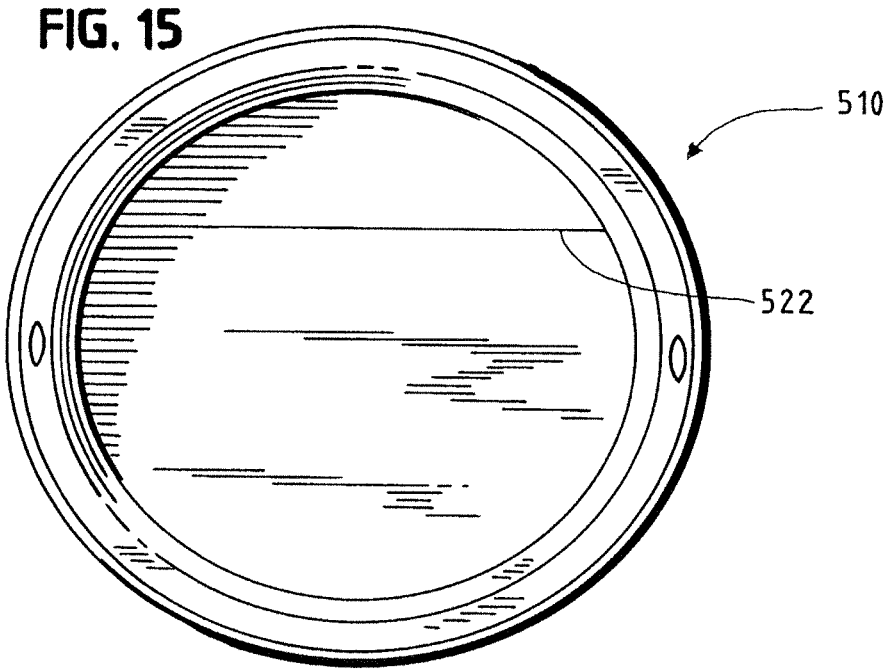
FIG. 15 is a top plan view of the cooking tray of FIG. 12 with an alternative fold line.
Figure 16:
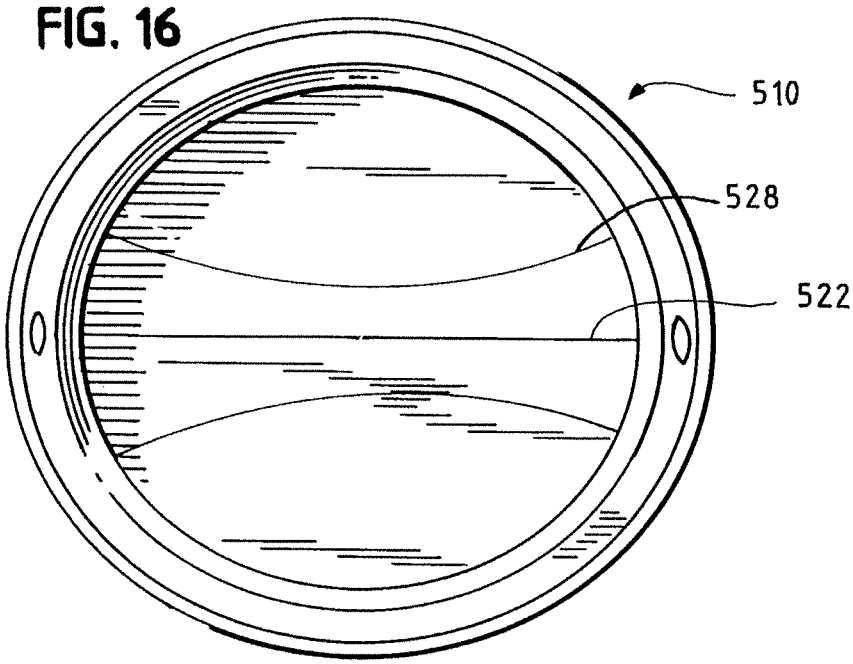
FIG. 16 is a top plan view of the cooking tray of FIG. 12 with an alternative fold line.

The fold line 522 may comprise a single fold line extending across the bottom wall 512 of the cooking tray 510 along a diameter thereof, as illustrated in FIG. 13. Alternatively, the fold line 522 may be positioned off-center, as illustrated in FIG. 15. In yet another alternative, the fold line 522 may have additional fold lines 528 positioned adjacent thereto. For example, an arcuate fold line 528 may be positioned on each side of the fold line 522, as illustrated in FIG. 16. The use of multiple fold lines 522 and 528 can facilitate a smoother fold region, as opposed to the more abrupt fold region that can result from a single fold line 522. The fold lines 522 and 528 may be in various forms, such as a continuous score line or an interrupted score line. The fold lines 522 and 528 may be linear, arcuate, or a combination thereof. The fold lines 522 and 528 may extend partially or entirely across the bottom wall, and may also extend in the sidewall 514 of the cooking tray 510. The fold lines 522 and 528 may intersect the apertures 520.

Figure 14A:
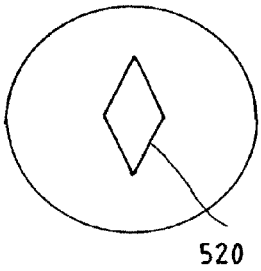
FIG. 14*a* is a detail view of an alternative sidewall aperture for the cooking tray of FIG. 12.
Figure 14B:
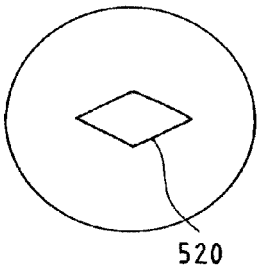
FIG. 14*b* is a detail view of an alternative sidewall aperture for the cooking tray of FIG. 12.
Figure 14C:
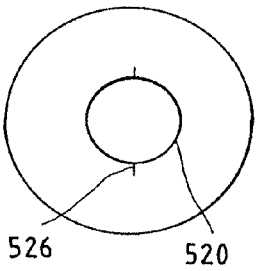
FIG. 14*c* is a detail view of an alternative sidewall aperture for the cooking tray of FIG. 12.
Figure 14D:
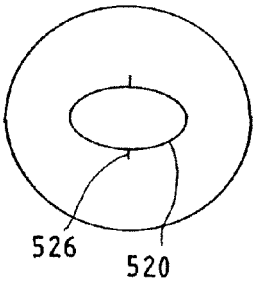
FIG. 14*d* is a detail view of an alternative sidewall aperture for the cooking tray of FIG. 12.

The apertures 520 can be in a variety of shapes, such as V-shaped, a diamond (illustrated in FIGS. 14*a* and 14*b*), a circle (illustrated in FIG. 14*c*), or an oval (illustrated in FIG. 14*d*). More than one shape of aperture 520 can be used on a cooking tray 510. The apertures 520 may have slits 526, and the slits 526 may be positioned to be aligned one of the fold lines 522 and 528 to facilitate folding of the cooking tray 510. If the aperture 520 has linear elements, such as if it is V-shaped or diamond shaped, then the linear elements may be configured such that an intersection therebetween is aligned with one of the fold lines 522 and 528. In addition, one or more apertures 520 may be associated with each of the fold lines 520 and 528, such as if multiple fold lines 520 and 528 are formed in the cooking tray 510. In addition, multiple apertures 520 may be associated with each end of the fold lines 522 and 528.

The apertures 520 are preferably, though not necessarily, placed along the sidewall 514 at a sufficient distance above the bottom wall 512 to reduce leakage of food product through the aperture 520. A film or other flexible barrier may be placed over the apertures 520 to reduce leakage of food product therethrough.

The cooking tray 510 may include a susceptor 524 disposed on at least a portion of the bottom wall 512 and/or the sidewall 514. The susceptor material is selected to absorb microwave energy and conduct heat to the food product. If the susceptor material is immediately adjacent the food product, the susceptor may brown or crisp the portion of the food product that it is in contact with.

The cooking tray 510 may be formed of a paperboard material that is shaped in a die using a forming tool. The susceptor 524, if present, may be a separate piece that is attached to the cooking tray 510 after forming. The susceptor 524 may also be disposed on the paperboard material prior to forming, so that the susceptor 524 and cooking tray 510 are formed generally simultaneously.

Although the cooking tray 10 or 510 is described and depicted herein as being substantially circular, other shapes of the cooking tray can be used. For example, the cooking tray could be ovular or generally rectangular, having rounded corners.

The cooking tray 10 or 510 may be used in microwave cooking of a variety of different food products. In one embodiment, the food product may be formed of multiple ingredients, at least one of which is in a generally liquid or otherwise flowable state. At least some of the different ingredients are individually packaged, as illustrated in FIG. 1. The flowable ingredient may be poured into the interior of the cooking tray 10 or 510 adjacent the bottom wall 12 or 512 and the upstanding sidewall 14 or 514. Other ingredients may be placed on top of or in the flowable ingredient to form the food product 36, as illustrated in FIG. 5.

Figure 5B:
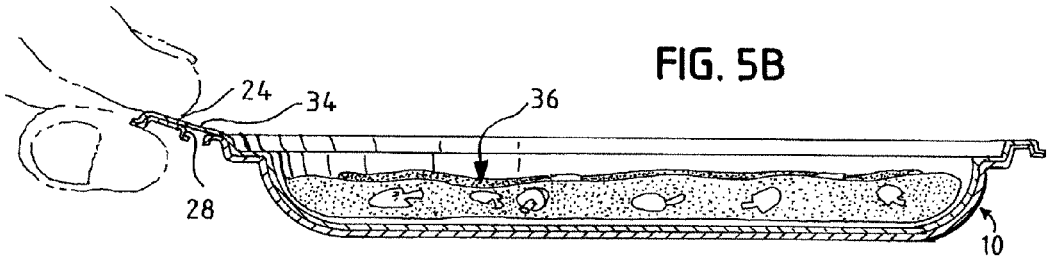
FIG. 5*b* is a side elevation cross-section view of the cooking tray and omelet of FIG. 5 with the opening tab being separated from the cooking tray.
Figure 5C:
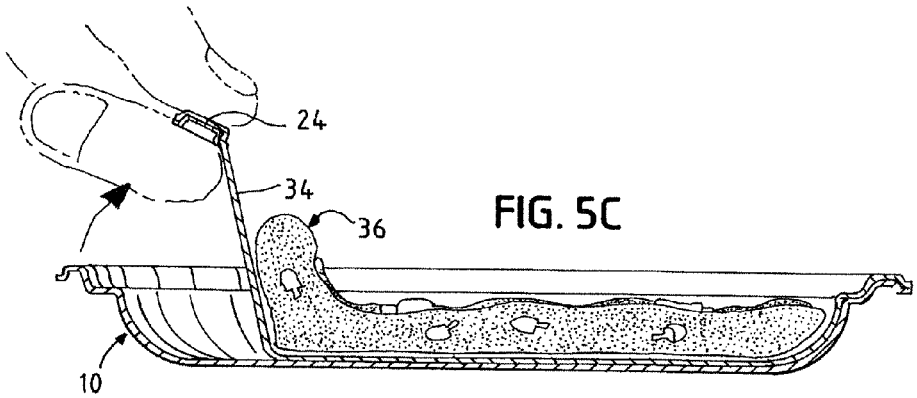
FIG. 5*c* is a side elevation cross-section view of the cooking tray and omelet of FIG. 5 with the opening tab being used to partially lift a liner and a portion of the omelet thereon from the cooking tray.
Figure 5D:
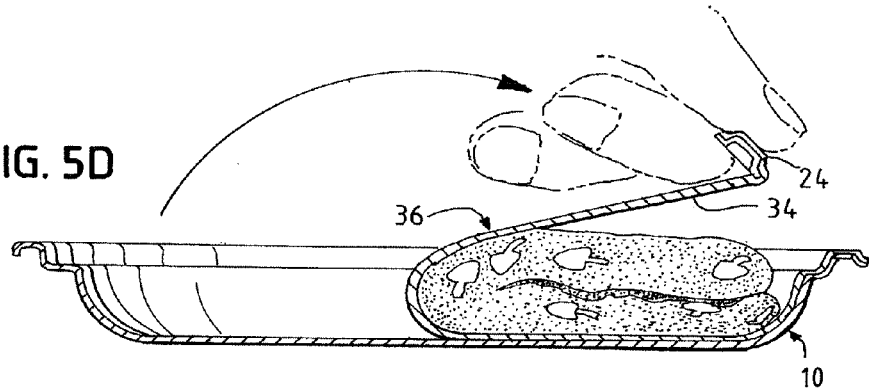
FIG. 5*d* is a side elevation cross-section view of the cooking tray and omelet of FIG. 5 with the opening tab being used to partially lift the liner and fold the omelet upon itself.
Figure 5E:
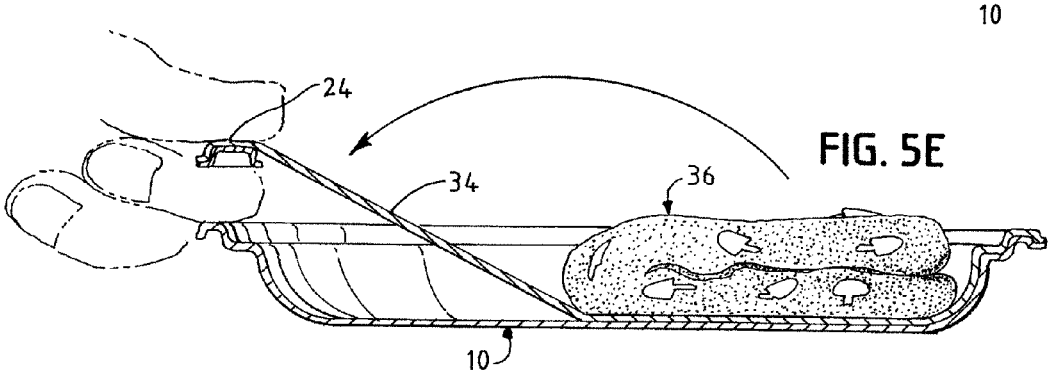
FIG. 5*e* is a side elevation cross-section view of the cooking tray and omelet of FIG. 5 with the opening tab being used to shift a portion of the liner away from the top of the folded omelet.

After microwave cooking of the food product 36, the separable tab 24 may be separated from the remained of the cooking tray 10 of the first embodiment discussed above along the line of weakness 28 therebetween, as illustrated in FIG. 5*b*. The separated tab 24 may then be used to peel the film liner 34 from a portion of the cooking tray 10 and thereby lift the food product 36 which is resting on the film liner 34, as illustrated in FIG. 5*c*. The lifted portion of the film liner 34 can be used to fold a portion of the food product 36 over upon another portion of the food product 36, as illustrated in FIG. 5*d*. Once the food product 36 has been folded, the portion of the film liner 34 that has been removed from the cooking tray 10 can be shifted to a position spaced from the food product 36, as illustrated in FIG. 5*e*. Alternatively, after the food product 36 has been folded the film liner 34 can also be entirely removed from the cooking tray 10 to thereby remove the food product 36 from the interior of the cooking tray 10.

In one embodiment, the food product 36 may comprise an omelet formed from several different ingredients, each of which are individually wrapped. The ingredients may include a liquid egg product 112 contained in a film pouch 102, a cheese product 114 contained in a film pouch and a vegetable product 116 contained in a film pouch, as illustrated in FIG. 1. The pouches 102, 104 and 106 may be formed of a transparent film, thereby allowing for visual identification of the ingredient contained therein. The pouches 102, 104 and 106 may also include an easy-opening feature, such as a tear notch, a score line or a thinned die line, to permit the pouches 102, 104 and 106 to easily be opened when desired. Instead of a film pouch, one or more of the ingredients may be contained in a cup having a removable lid. The ingredient containers 102, 104 and 106 are preferably sized such that they be packaged within the interior of the cooking tray 10 and not substantially protrude therefrom, thus allowing the ingredients 112, 114 and 116 and cooking tray 10 to be packaged in a space-saving configuration as a meal kit 100. A film may cover the ingredient pouches 102, 104 and 106 prior to use to generally secure them in the cooking tray 10 or 510. Alternatively, or in addition, an adhesive, such as hot melt glue, may be used to secure the ingredient pouches 102, 104 and 106 relative to the cooking tray 10 or 510. If such an adhesive is used, it is preferable that it is easily peelable from the film liner 34, such that removal of the ingredient pouches 102, 104 and 106 results in removal of any adhesive from the film liner 34.

In order to assemble the omelet 36, the three ingredient pouches are first removed from the interior of the cooking tray 10 or 510. The pouch 102 containing the egg product 112 is opened and the liquid egg product is poured into the interior of the cooking tray 10 or 510. Next, the pouches 104 and 106 containing the cheese product 114 and vegetable product 116 are opened and their contents placed on top of the egg product 112. All of the ingredients 112, 114 and 116 can then be cooked in the cooking tray in the microwave oven. Alternatively, the egg product 112 alone can be at least partially cooked in the microwave oven, and then the cheese product 114 and vegetable product 116 placed on top and all three ingredients 112, 114 and 116 then cooked in the microwave oven. Following microwave cooking of all three ingredients, 112, 114 and 116, in the first embodiment of the cooking tray 10, the separable tab 24 can be separated from the remainder of the cooking tray 10 via the line of weakness 28. Then separated tab 24 can then be used to peel the film liner 34 from the cooking tray 10 and manipulate the omelet 36, as illustrated in FIGS. 5*c*, 5*d*, and 5*e* to fold the omelet 36. In the second embodiment of the cooking tray 510, the cooking tray 510 can be folding along the one or more fold lines 522 and 528 in order to fold the food product. The cooked, folded omelet is then ready for consumption.

Although ingredients for the omelet 36 are described above and illustrated as comprising egg, cheese and vegetable products 112, 114 and 116, many other different omelet ingredients can be provided. For example, potatoes, onions, peppers, mushrooms, tomatoes and other vegetables can be provided. One or more different meat types, such as bacon, ham, and/or steak can also be provided. Furthermore, the cheese product may comprise a blend of cheese. Seasonings, such as a southwest flavoring, can also be provided. The different ingredients can be packaged in various combinations to provide different meal kits that can be used to make different types of omelets. For instance, ingredients for making a southwest-style omelet or a Denver omelet can be provided in a meal kit.

Moreover, the food product is not limited to being an omelet, but rather can be any type of food product that is suitable for microwave cooking. Preferably, the food product includes an ingredient that is liquid or in an otherwise flowable state. For example, a crepe can be made using the cooking tray 10 or 510 described herein, or other such suitable trays that may lack the film liner 34 feature. In one embodiment, the crepe may be formed using a liquid batter ingredient and a fruit ingredient, such as sliced bananas. A syrup or chocolate ingredient may also be provided for use before or after microwave cooking of the food product. In another embodiment, a pancake may be formed using a liquid batter ingredient that has another ingredient, such as chocolate chips, blueberries, cherries, bananas or the like, either mixed in the liquid batter prior to cooking or placed on top of the liquid batter.

Figure 6:
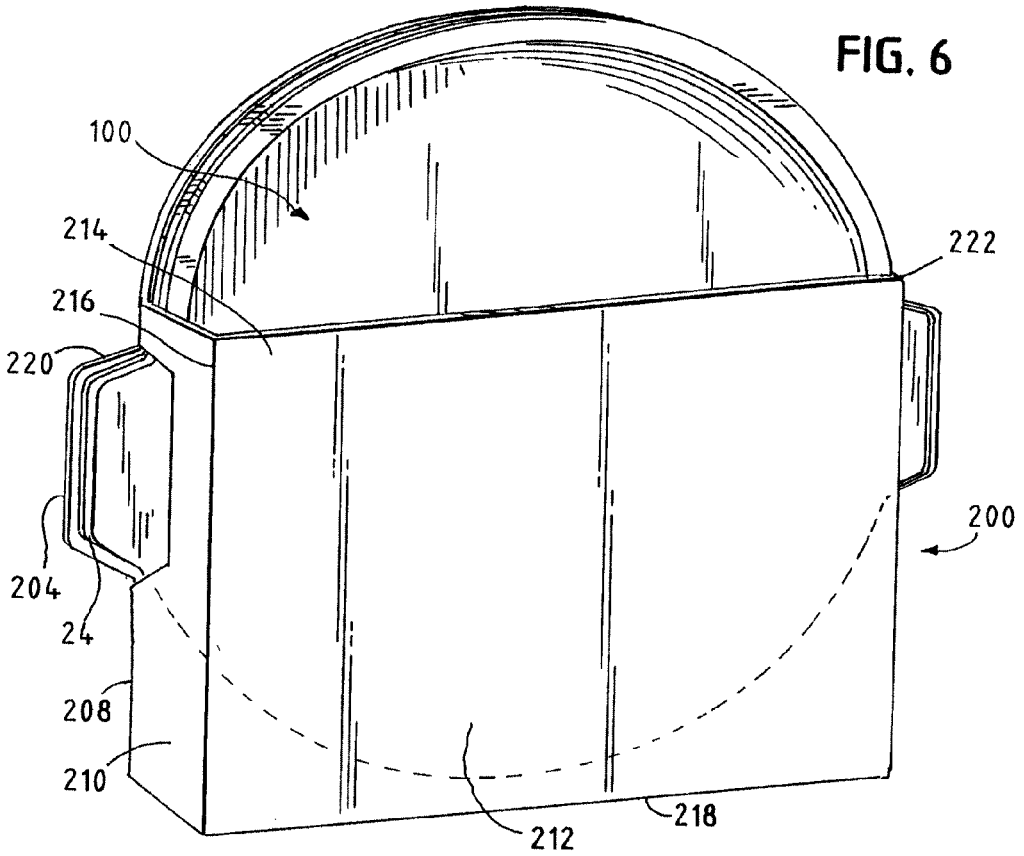
FIG. 6 is a rear perspective view of a first package embodiment of a meal kit.
Figure 7:
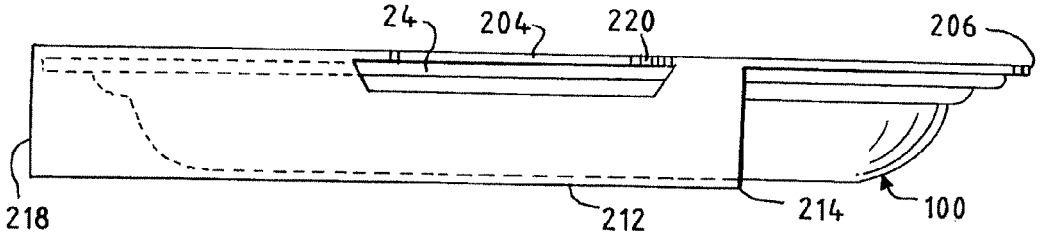
FIG. 7 is a side elevation view of the first package embodiment of the meal kit of FIG. 6.
Figure 8:
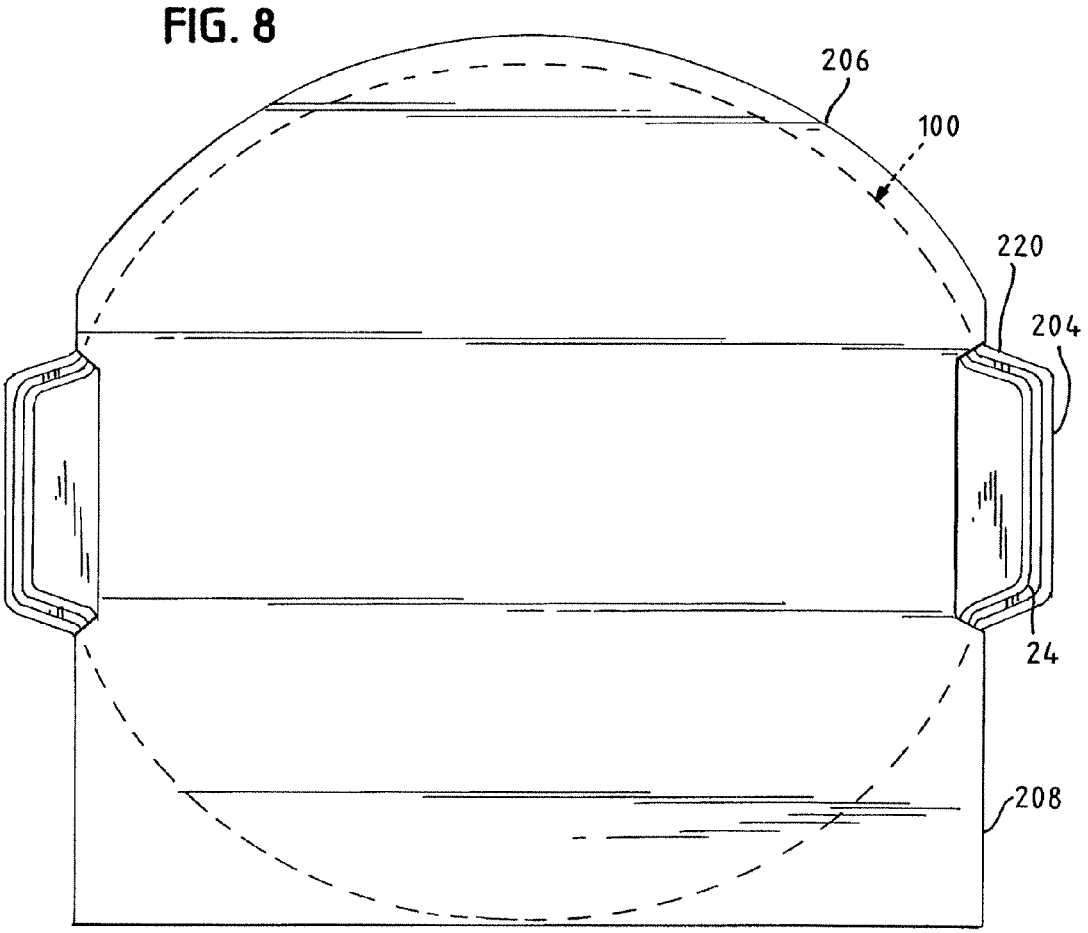
FIG. 8 is a back elevation view of the first package embodiment of the meal kit of FIG. 6.
Figure 9:
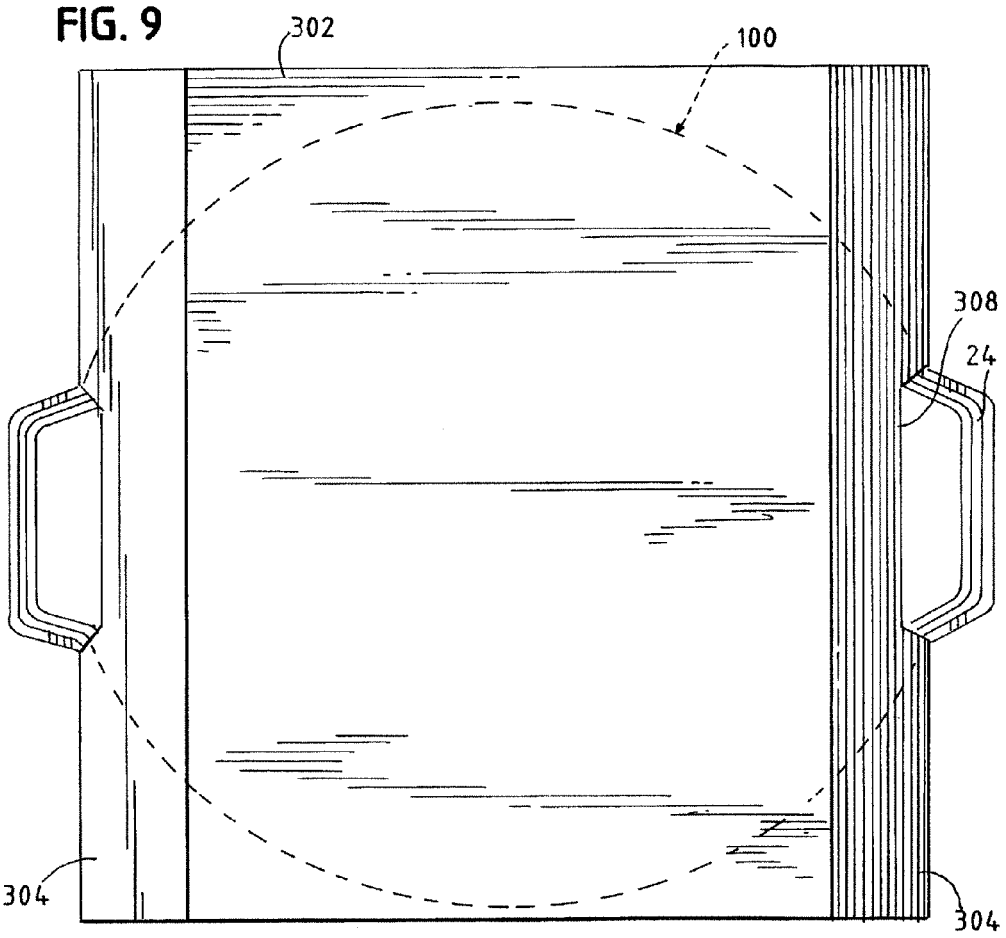
FIG. 9 is a front elevation view of a second package embodiment of a plurality of meal kits.
Figure 10:
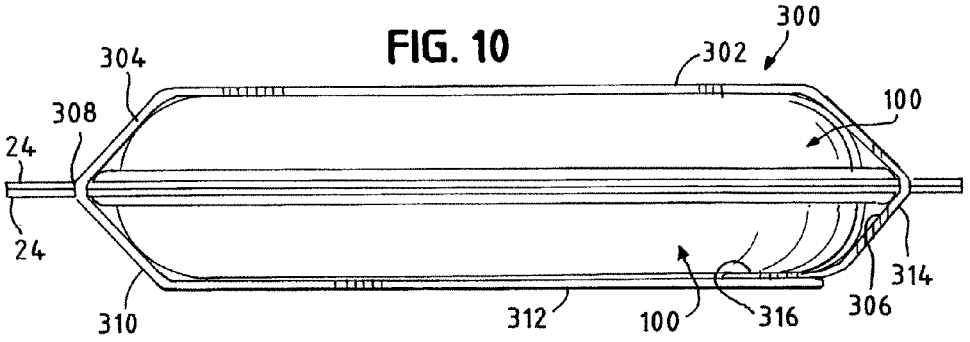
FIG. 10 is a top plan view of the second package embodiment of the plurality of meal kits of FIG. 9.
Figure 11:
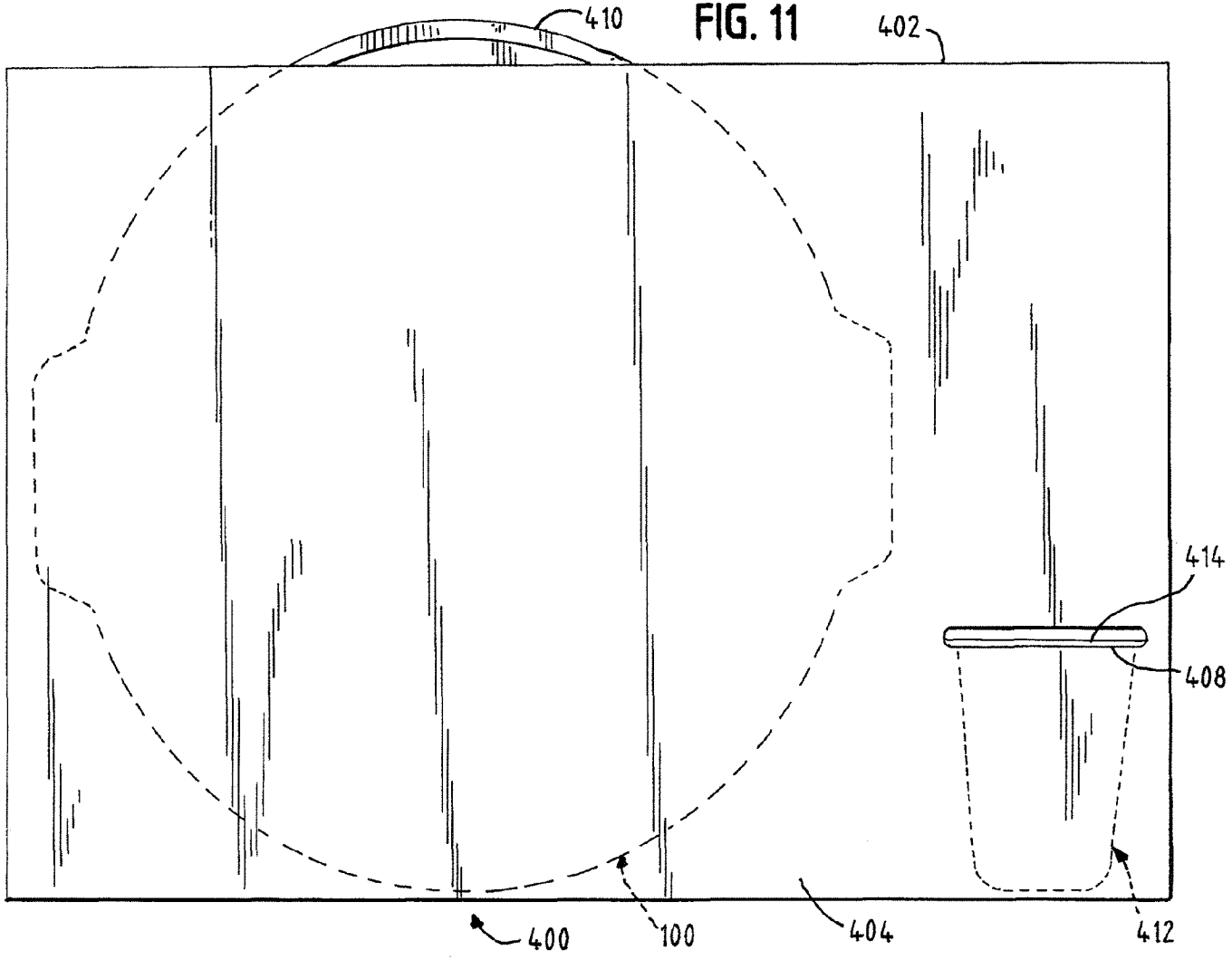
FIG. 11 is a front elevation view a third package embodiment of a plurality of meal kits.
Figure 12:
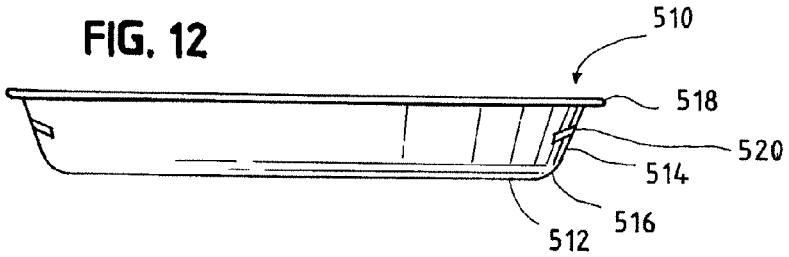
FIG. 12 is a side elevation view of a second embodiment of a cooking tray.

The meal kit 100 can be packaged either singularly, as illustrated in the packaging embodiment of FIGS. 6-8, or with additional meal kits 100, as illustrated in the packaging embodiments of FIGS. 9-11. When a plurality of meal kits 100 are packaged together, the meal kits 100 may be identical or they may be different. The packaging for the meal kits 100 preferably, though not necessarily, permits the meal kit or kits 100 contained therein to be supported in a vertically-orientated direction. Such an orientation can minimize the footprint occupied by the packaged meal kits while also presenting a large area upon which graphics or other visually appealing indicia can be displayed.

In a first embodiment of packaging for a meal kit 100, illustrated in FIGS. 6-8, the packaging 200 contains a single meal kit 100. The packaging comprises a unitary paperboard blank that has been folded to have a front panel 202, a pair of side panels 210 and 224 and a back panel 212. The back panel 212 is generally rectangular. The front panel 202, however, includes a rectangular portion 208 and a semicircular portion 206. The semicircular portion 206 extends above an upper edge 214 of the back panel 212 and upper edges 216 and 222 of the side panels 210 and 224, as illustrated in FIG. 7, which define a top opening of the packaging 200. The bottom edges of the panels 202, 210, 212 and 224 are aligned to form a bottom support 218 which can maintain the packaging 200 with the meal kit 100 therein in an upright position. A pair of slots 220 are formed in the sidewalls 210 and are sized to permit the tabs 24 of the cooking tray 10 of the meal kit 100 to project therethrough when the meal kit 100 is positioned inside the packaging 200. When the tabs 24 of the cooking tray 10 are projecting through the slots 220, the cooking tray 10 is generally secured relative to the packaging 200. Extensions are provided on the front panel 202 that are sized to extend over the tabs 24 when they are projecting through the slots 220.

In a second embodiment of packaging for a meal kit 100, illustrated in FIGS. 9 and 10, the packaging 300 contains a pair of meal kits 100. The packaging 300 comprises a unitary paperboard blank that is formed into a sleeve. The packaging 300 has six primary panels, including a generally rectangular front panel 302, a generally rectangular back panel 312, a first pair of side panels 304 and 310 extending between parallel edges of the front and back panels 302 and 312, and a second pair of side panels 306 and 314 extending between parallel edges of the front and back panels 302 and 312 opposite the first pair of side panels 306 and 314, as illustrated in FIG. 10. The packaging 300 also has a secondary panel 316 attached to an edge of one of the side panels 314. The secondary panel 316 can be joined to an inner surface of the back panel 312, such as with an adhesive, in order to form the blank into the sleeve configuration. Each of the pair of side panels 306, 314 and 302, 312 extends outwardly from the associated front or back panel 302 or 312 and at an inward angle. An opening 308 is formed where each of the pairs of side panels 306, 314 and 302, 312 meets. The openings 308 are positioned such that the tabs 24 of the cooking trays of the meal kits 100 project therethrough when the meal kits 100 are positioned within the packaging 300. The meal kits 100 may be aligned so that the bottom walls 12 of the cooking trays 10 are each outwardly facing and the interiors of the cooking trays 10 are facing each other, and the tabs 24 are aligned. The bottom edges of the panels 302, 304, 306, 314, 302 and 312 are aligned to form a bottom support which can maintain the packaging 300 with the meal kits 100 therein in an upright position.

In a third embodiment of packaging for a meal kit 100, illustrated in FIG. 11, the packaging 400 can contain either a single meal kit 100 or more than one meal kit 100. The packaging 400 is generally in the form of a rectangular carton, having a front panel 404, a back panel, a top panel 402, a pair of side panels and a bottom panel. The liquid ingredient may be provided in a cup 412 having an upper rim. The front panel 404 and/or the back panel of the packaging 300 may be provided with a slot 408 through which the rim 414 of the cup 412 can project in order to generally secure the cup 412 relative to the packaging 300. If multiple meal kits 100 are provided within the packaging 300, then a second slot for receiving the rim of a second cup can also be located in the front panel 404 and/or the back panel, such as above the first slot 408. In addition, one or more slots 410 may be formed in the top panel 402 of the packaging 300 and positioned such that a tab 24 or side portion of the cooking tray 10 of a meal kit 100 can project therethrough to generally secure the meal kit 100 in position.

Although the meal kits described above and illustrated in FIGS. 6-11 are described by way of example with the first embodiment of the cooking tray 10, other cooking trays, such as the cooking tray 510, can also be used. For example, tabs can be provided on the rim 518 of the cooking tray 510 of the second embodiment for use with the packaging described herein.

The drawings and the foregoing descriptions are not intended to represent the only forms of the meal kit and cooking tray in regard to the details of construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation.

The invention claimed is:

1. A cooking tray for use in microwave cooking of a food product, the cooking tray comprising:

a generally planar bottom wall having a fold line extending substantially thereacross and an arcuate fold line positioned on each side of the fold line, wherein the arcuate fold lines are closer to each other along a mid-point;

an upstanding sidewall extending around the periphery of the bottom wall, the sidewall having a pair of apertures, one of the apertures being aligned with one end of the fold line and the other of the apertures being aligned with the other end of the fold line, the pair of apertures being disposed in the upstanding portion of the sidewall and spaced from an outwardly extending peripheral rim.

2. A cooking tray for use in microwave cooking of a food product, the cooking tray comprising: a generally planar bottom wall having a fold line extending substantially thereacross; an upstanding sidewall extending around the periphery of the bottom wall, the sidewall having a pair of apertures, one of the apertures being aligned with one end of the fold line and the other of the apertures being aligned with the other end of the fold line, the pair of apertures being disposed in the upstanding portion of the sidewall and spaced from an outwardly extending peripheral rim, wherein the height of each of the pair of apertures is less than the width.

* * * * *